US009721402B2

(12) United States Patent
Gosterisli et al.

(10) Patent No.: US 9,721,402 B2
(45) Date of Patent: Aug. 1, 2017

(54) ACCESS CONTROL APPARATUS WITH MODULAR ENCODER SUBASSEMBLY

(71) Applicant: Onity Inc., Duluth, GA (US)

(72) Inventors: Levent Gosterisli, Decatur, GA (US); Craig Bonnett, Atlanta, GA (US); Alberto Vecchiotti, Charlotte, NC (US); Dennis Bailey, Dacula, GA (US)

(73) Assignees: UTC FIRE & SECURITY CORPORATION, Farmington, CT (US); ONITY, INC., Duluth, GA (US)

( * ) Notice: Subject to any disclaimer, the term of this patent is extended or adjusted under 35 U.S.C. 154(b) by 0 days.

(21) Appl. No.: 14/422,057

(22) PCT Filed: Aug. 14, 2013

(86) PCT No.: PCT/US2013/054846

§ 371 (c)(1),
(2) Date: Feb. 17, 2015

(87) PCT Pub. No.: WO2014/028564

PCT Pub. Date: Feb. 20, 2014

(65) Prior Publication Data

US 2015/0193998 A1 Jul. 9, 2015

Related U.S. Application Data

(60) Provisional application No. 61/684,175, filed on Aug. 17, 2012.

(51) Int. Cl.
*G07C 9/00* (2006.01)

(52) U.S. Cl.
CPC ..... *G07C 9/00007* (2013.01); *G07C 9/00904* (2013.01); *G07C 9/00944* (2013.01); *G07C 2009/00873* (2013.01)

(58) Field of Classification Search
CPC ..... G07C 9/00904; G07C 9/00944; G07C 2009/00873; G07C 9/00; G07C 9/00007
See application file for complete search history.

(56) References Cited

U.S. PATENT DOCUMENTS 5,603,078 A 2/1997 Henderson
6,068,193 A 5/2000 Kreft
(Continued)

FOREIGN PATENT DOCUMENTS

AU 2006209369 A1 3/2007
AU 2010343862 A1 10/2011
(Continued)

OTHER PUBLICATIONS

International Search Report for application PCT/US/2013/054846, dated Nov. 7, 2013, 3 pages.
(Continued)

*Primary Examiner* — Ted Wang
(74) *Attorney, Agent, or Firm* — Cantor Colburn LLP

(57) ABSTRACT

Apparatuses are provided for performing physical access control using various types of encoding technologies by removably incorporating modular encoder subassemblies. An access control apparatus includes access control electronics and at least one docking bay or slot for removably housing at least one modular encoder unit. The encoder unit can be removably house in the docking bay or slot of the access control apparatus and be removably linked, communicatively and/or physically, to the access control electronics when housed in the access control apparatus, and can interface with and write or read information to or from a credential. When removably housed in the docking bay or slot, the encoder unit can receive identity data from the access control electronics and bind the identity data to the credential.

8 Claims, 3 Drawing Sheets

(56) References Cited

U.S. PATENT DOCUMENTS

| | | | | |
|---|---|---|---|---|
| 6,364,208 | B1 | 4/2002 | Stanford et al. | |
| 6,375,084 | B1 | 4/2002 | Stanford et al. | |
| 6,402,038 | B1 | 6/2002 | Stanford et al. | |
| 6,497,368 | B1 | 12/2002 | Friend et al. | |
| 6,510,998 | B1 | 1/2003 | Stanford et al. | |
| 6,946,984 | B2 | 9/2005 | Rubin et al. | |
| 7,073,712 | B2 | 7/2006 | Jusas et al. | |
| 7,242,335 | B2 | 7/2007 | Rubin et al. | |
| 7,380,714 | B2 | 6/2008 | Jusas et al. | |
| 7,416,121 | B2 | 8/2008 | Zimmerman | |
| 7,639,443 | B2 | 12/2009 | Isono et al. | |
| 8,016,194 | B2 | 9/2011 | Hause et al. | |
| 8,111,143 | B2 | 2/2012 | Tong et al. | |
| 8,203,469 | B2 | 6/2012 | Choi et al. | |
| 8,446,728 | B1 * | 5/2013 | McDonald ..... | G06K 19/07739 361/737 |
| 2002/0034321 | A1 | 3/2002 | Saito | |
| 2003/0144956 | A1 | 7/2003 | Yu, Jr. et al. | |
| 2004/0222299 | A1 | 11/2004 | Hsieh et al. | |
| 2007/0057057 | A1 | 3/2007 | Andresky et al. | |
| 2007/0251999 | A1 | 11/2007 | Bohlke et al. | |
| 2009/0303013 | A1 | 12/2009 | Edgerton | |
| 2010/0088576 | A1 | 4/2010 | Isono et al. | |
| 2010/0214065 | A1 | 8/2010 | Maltseff et al. | |
| 2010/0271179 | A1 | 10/2010 | Maltseff | |
| 2011/0053556 | A1 * | 3/2011 | Masaryk ..... | G06F 3/03541 455/406 |
| 2011/0141534 | A1 | 6/2011 | Safonov et al. | |
| 2011/0148585 | A1 | 6/2011 | Bae et al. | |
| 2011/0165862 | A1 | 7/2011 | Yu et al. | |
| 2012/0005096 | A1 | 1/2012 | Dorsey et al. | |

FOREIGN PATENT DOCUMENTS

| | | | |
|---|---|---|---|
| CN | 1247586 | A | 3/2000 |
| CN | 1468342 | A | 1/2004 |
| CN | 1829983 | A | 9/2006 |
| CN | 201174755 | Y | 12/2008 |
| CN | 101976324 | A | 2/2011 |
| CN | 102160090 | A | 8/2011 |
| CN | 102377859 | A | 3/2012 |
| EP | 0682608 | A1 | 11/1995 |
| EP | 0870271 | A1 | 10/1998 |
| EP | 1213417 | A2 | 6/2002 |
| EP | 1762960 | A2 | 3/2007 |
| EP | 1846839 | A2 | 10/2007 |
| EP | 2424157 | A1 | 2/2012 |
| JP | 2002312133 | A | 10/2002 |
| WO | 9305987 | A1 | 4/1993 |
| WO | 03065163 | A2 | 8/2003 |
| WO | 2006066157 | A2 | 2/2005 |
| WO | 2007109740 | A2 | 9/2007 |
| WO | 2008027622 | A2 | 3/2008 |
| WO | 2008027623 | A2 | 3/2008 |
| WO | 2009111016 | A2 | 9/2009 |
| WO | 2009158181 | A1 | 12/2009 |

OTHER PUBLICATIONS

Written Opinion for application PCT/US/2013/054846, dated Nov. 7, 2013, 5 pages.

Chinese Office Action and Search Report for application 201380044070.0, mailed Mar. 30, 2016, 15 pages.

Chinese Second Office Action for application CN 201380044070.0, Issued Nov. 22, 2016, 15 pages.

* cited by examiner

ACCESS CONTROL APPARATUS WITH MODULAR ENCODER SUBASSEMBLY

FIELD

The present teachings relate generally to electronic access control apparatuses having modular encoder subassemblies, and more particularly, to platforms and techniques for performing physical access control using various types of encoding technologies by removably incorporating modular encoder subassemblies in electronic access control apparatuses.

BACKGROUND

Physical access control devices in hospitality applications employ different variations of encoding technologies, such as magnetic stripe, including high-coercivity magstripe and low-coercivity magstripe, radio-frequency identification, motorized, etc. Such physical access control devices typically house, in single integrated units, both encoding devices and access control management software that create data to be encoded on keycards.

SUMMARY

The following presents a simplified summary in order to provide a basic understanding of some aspects of one or more embodiments of the present teachings. This summary is not an extensive overview, nor is it intended to identify key or critical elements of the present teachings or to delineate the scope of the disclosure. Rather, its primary purpose is merely to present one or more concepts in simplified form as a prelude to the detailed description presented later.

According to the present teachings in one or more aspects, electronic access control apparatuses for performing physical access control are provided, in which modular encoder subassemblies are removably incorporated in the access control apparatuses. A physical access control apparatus includes access control electronics and at least one dock, such as a bay or slot, for removably housing at least one modular encoder unit. In general implementations of the present teachings, the encoder unit can be removably housed in the dock of the physical access control apparatus and be removably linked, communicatively and/or physically, to the physical access control electronics when housed in the physical access control apparatus, and can interface with and read or write information from or to a credential such as, for example, a keycard, a transponder, a near field communication device, and the like.

It is to be understood that both the foregoing general description and the following detailed description are exemplary and explanatory only and are not restrictive of the invention, as claimed.

DESCRIPTION OF THE DRAWINGS

The accompanying drawings, which are incorporated in and constitute a part of this specification, illustrate aspects of the present teachings and together with the description, serve to explain principles of the present teachings. In the figures.

DETAILED DESCRIPTION

Figure 1:
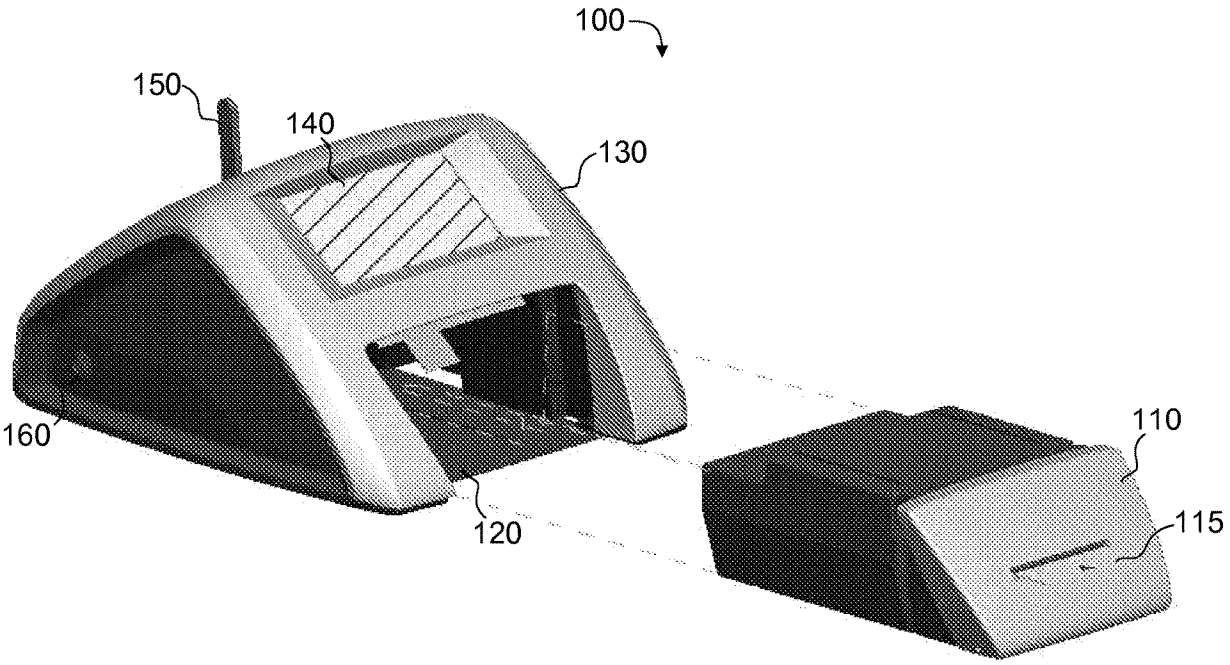
FIGS. 1 and 2 illustrate an exemplary physical access control apparatus that can removably incorporate modular encoder subassemblies, consistent with various embodiments of the present teachings.

Reference will now be made in detail to various embodiments of the present teachings, an example of which is illustrated in the accompanying drawings. Wherever possible, the same reference numbers will be used throughout the drawings to refer to the same or like parts. In the following description, reference is made to the accompanying drawings that form a part thereof, and in which is shown by way of illustration specific implementations in which may be practiced. These implementations are described in sufficient detail to enable those skilled in the art to practice these implementations and it is to be understood that other implementations may be utilized and that modifications and equivalents may be made without departing from the scope of the present teachings. The following description is, therefore, merely exemplary.

Additionally, in the subject description, the word "exemplary" is used to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

As used herein and unless otherwise specified, the term "physical access control" refers to the exertion of control over access to physical resources and facilities, such as buildings, rooms, airports, warehouses, and the like; the term "credential" encompasses evidence attesting to one's right to access controlled physical resources and facilities, examples of which include a keycard, a transponder, a near field communication device, and the like, that are bound to or otherwise associated with an individual or a group of individuals; the terms "encoder" and "encoder unit" encompass any electronic component that converts information from one format to another format and is capable of binding identity data of an individual or a group of individuals to a credential, examples of which include a credential encoder, a credential writer, a keycard printer, and the like.

Aspects of the present teachings relate to physical access control apparatuses having modular encoder subassemblies. More particularly, in various aspects, and as for example generally shown in FIGS. 1 and 2, disclosed herein is an access control apparatus 100 that can perform physical access control using one or more types of encoding technologies by removably housing modular encoder subassemblies, such as various modular encoder units 110, 210, in at least one dock 120 of a housing 130 of access control apparatus 100. Dock 120 can be formed in or on housing 130 in the form of, for example, a slot, a bay, an opening, a cavity, and the like. Housing 130 can contain access control electronics of access control apparatus 100, and can include a user interface 140 and an input/output interface 150. Input/output interface 150 is shown in FIGS. 1 and 2 as partially external of housing 130, but in various embodiments, input/output interface 150 can be fully incorporated within housing 130.

By utilizing a modular architecture, various embodiments of access control apparatus 100 have the flexibility of utilizing different types of encoding technologies and migrating or upgrading to other encoding technologies in the future, without having to replace other components of access control apparatus 100, such as housing 130 and the access control electronics contained therein, user interface 140, input/output interface 150, and the like. This contrasts with integrated physical access control devices that combine encoding devices and access control electronics together in single integrated units, which create a hurdle for customers, such as those in hospitality industries, when the customers upgrade or modify their existing integrated access control devices to implement newer and/or different encoding technologies. For instance, when the customers lease or purchase integrated access control devices that employ a certain type of encoding technology, they are stuck with that type of encoding technology in the future unless they lease or purchase entire new units of physical access control devices. This increases the customers' operational expenses when replacing outdated or damaged encoding devices or migrating to a different encoding technology, in terms of cost and time required to lease or purchase and install entirely new physical access control devices.

Figure 2:
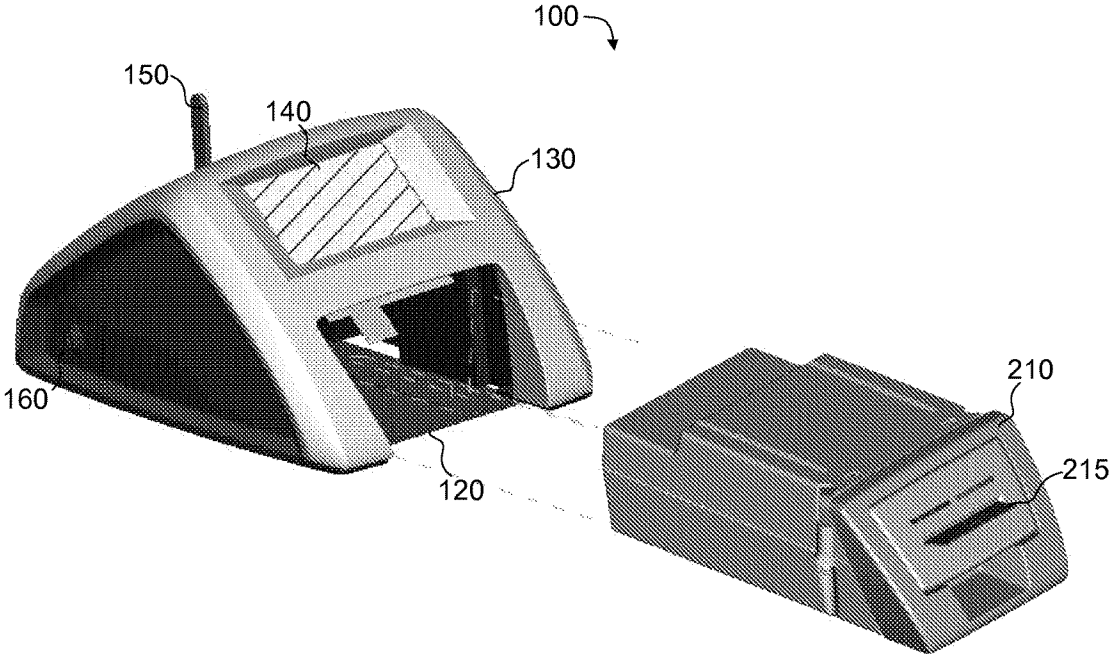

As generally shown in FIGS. 1 and 2, access control apparatus 100 can include at least one dock 120 in housing 130, within which appropriately dimensioned modular encoder units 110, 210 can be removably incorporated in access control apparatus 100. Modular encoder units 110, 210 can be removably housed in dock 120 and be removably linked or coupled, communicatively and/or physically, to the access control electronics of access control unit 130 when removably incorporated in access control apparatus 100, and can interface with and encode/write information to a credential such as, for example, a card (e.g., cards 115, 215), a transponder (not shown), a near field communication device (not shown), and the like. Types of cards 115, 215 can include, for example, magnetic stripe (e.g., high-coercivity magnetic stripe, low-coercivity magstripe, etc.), proximity (e.g., Wiegand, etc.), integrated circuit (e.g., contact smart card, contactless smart card, etc.), radio-frequency identification (e.g., Bluetooth, near field communication, etc.), and other types known to one skilled in the art.

In various embodiments, modular encoder units 110, 210 can be a credential encoder/writer. A credential encoder/writer can, for example, receive identity data or other evidence attesting to one's access right associated with an individual or a group of individuals from access control components (e.g., access control unit 130, control panels, head-end servers, etc.), write the identity data to a credential or otherwise use the identity data to bind or associate the credential to the individual or group of individuals, and/or receive and write authentication data (e.g., a personal identification number, a password, a biometric feature, etc.) to the credential. The credential encoder/writer can also verify that a credential has been successfully bound or associated with an individual or a group of individuals, by, for example, reading identity data or other evidence attesting to one's access right from the credential, accepting authentication data, and/or communicating the identity data and/or authentication data to access control components (e.g., access control unit 130, control panels, head-end servers, etc.)

Dock 120 can be formed from at least one opening in or area on housing 130 of access control apparatus 100, and can include one or more guide elements, such as rails or grooves, for guiding modular encoder units 110, 210 during mounting and removal. Dock 120 can also include one or more fastening elements, such as tabs or flanges, for physically attaching and/or affixing one of modular encoder units 110, 210 to access control unit 130 when that modular encoder unit is in a registered position in dock 120. Access control apparatus 100 can further include a securing mechanism 160, such as a lock or a tamper-resistance screw, for securing one of modular encoder units 110, 210 when that modular encoder unit is removably housed in dock 120. Securing mechanism 160 can be an electronically actuated lock and secure or release a removably housed modular encoder unit in response to user input via user interface 140 or a remote control panel.

Access control apparatus 100 can utilize user interface 140 to provide information to a user and/or receive user input. User interface 140 can include, for example, a keypad, a display screen, a touch screen, and other types of user interfaces known to one skilled in the art. For example, when a user (e.g., an administrator) wants to bind or otherwise associate a credential with an individual or a group of individuals and presents the credential to a modular credential encoder/writer (e.g., modular encoder unit 110 or 210) that has been removably incorporated in access control apparatus 100, access control apparatus 100 can inform the user whether or not the credential has been successfully bound, or display a keypad or a graphical user interface ("GUI") for the user to enter authentication data (e.g., a PIN, a password, a biometric feature, etc.) to be stored on or associated with the credential. For another example, when a user wants to verify that a credential has been successfully bound to or associated with an individual or a group of individuals, the user can present the credential to a modular credential encoder/writer (e.g., modular encoder unit 110 or 210) that has been removably incorporated in access control apparatus 100, and access control apparatus 100 can inform the user whether or not the credential has been successfully bound.

In further embodiments, when one of modular encoder units 110, 210 is being removably incorporated (e.g., being mounted) in dock 120, access control apparatus 100 can require an activation code via user interface 140 prior to communicatively linking to that modular encoder unit. When a removably incorporated modular encoder unit is being removed (e.g., being unmounted) from dock 120, access control apparatus 100 can require an authorization code via user interface 140 prior to allowing the removal of that modular encoder unit, for example, by controlling securing mechanism 160.

Figure 3:
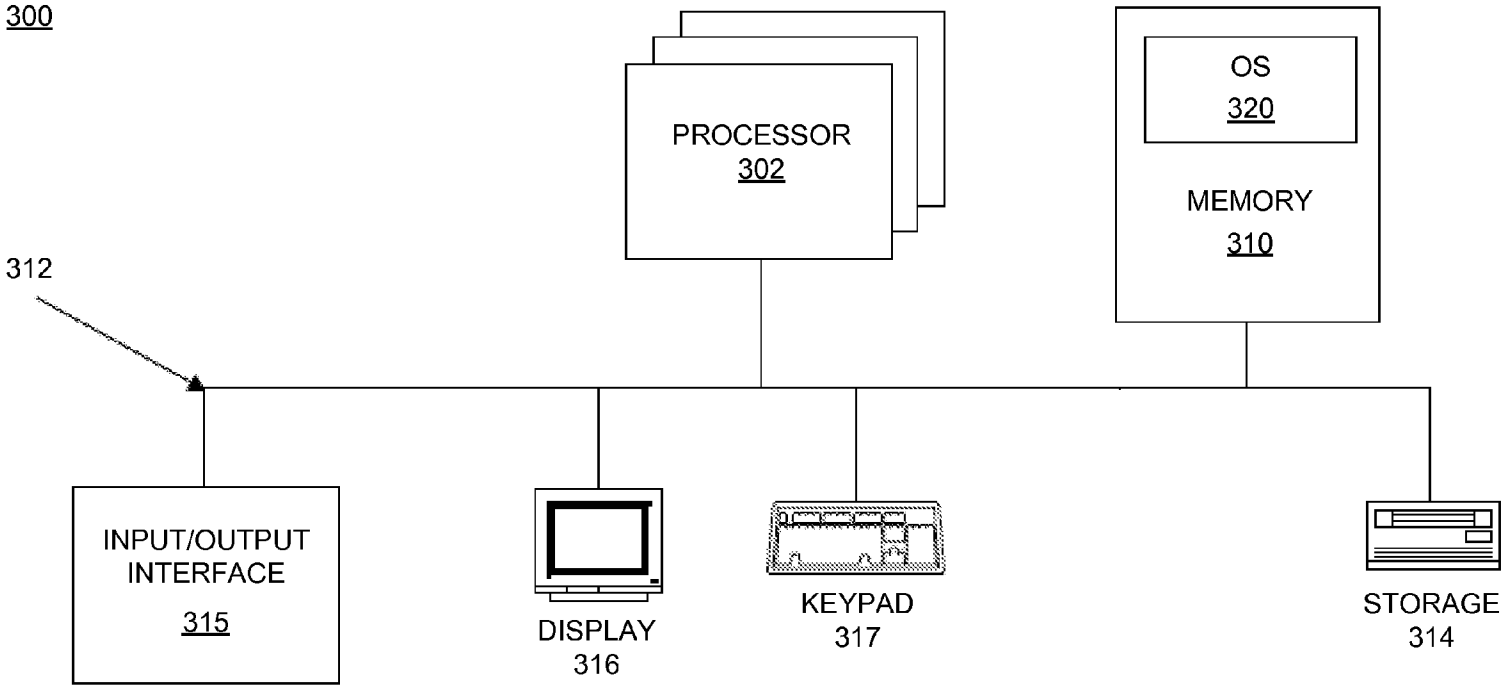
FIG. 3 illustrates a computer system that is consistent with embodiments of the present teachings.

FIG. 3 illustrates a computer system 300 that is consistent with embodiments of the present teachings. In general, embodiments of access control apparatus 100 as shown in FIGS. 1 and 2 can be implemented in various physical access control systems, such as an embedded system, a personal computer, a server, a workstation, or a combination thereof, an example of which is shown as system 300. Certain components of access control apparatus 100 can be embedded as a computer program. The computer program can exist in a variety of forms both active and inactive. For example, the computer program can exist as software program(s) comprised of program instructions in source code, object code, executable code or other formats; firmware program(s); or hardware description language (HDL) files. The computer program can be embodied on a computer readable medium, which includes storage devices and signals, in compressed or uncompressed form. However, for purposes of explanation, system 300 is shown as a general purpose computer that is well known to those skilled in the art. Examples of the components that may be included in system 300 will now be described.

As shown, system 300 can include at least one processor 302, main memory 310, a storage device 314, an input/output interface 315, a display 316, and a keypad 317. In various embodiments, input/output interface 315 can correspond to input/output interface 150 as shown in FIGS. 1 and 2, and display 316 and/or keypad 317 can correspond to user interface 140 as shown in FIGS. 1 and 2. One skilled in the art will recognize that system 300 can include multiple processors 302. Main memory 310 serves as a primary storage area of system 300 and holds data that is actively used by applications, such as access control apparatus 100, running on processor 302. One skilled in the art will recognize that applications are software programs that each contains a set of computer instructions for instructing system 300 to perform a set of specific tasks during runtime, and that the term "applications" may be used interchangeably with application software, application programs, and/or programs in accordance with embodiments of the present teachings. Memory 310 can be implemented as a random access memory or other forms of memory as described below, which are well known to those skilled in the art. Storage device 314 can comprise, for example, RAM, ROM, flash memory, EEPROM, CD-ROM or other optical disk storage, magnetic disk storage or other magnetic storage devices, or any other medium that can be used to carry or store desired program code in the form of instructions or data structures and that can be accessed by a computer. A copy of the computer program embodiment of access control apparatus 100 can be stored on, for example, storage device 314.

Input/output interface 315 enables system 300 to interface and communicate with various components and modules of the physical access control systems, such as modular encoders (e.g., modular encoder units 110 and 210), control panels, head-end servers, and the like, via wired communications (e.g., USB, RS232, RS485, TTL, and the like) and/or wireless communications (e.g., Bluetooth, Zigbee, Wi-Fi, and the like). In various embodiments, input/output interface 315 can be programmed to interface and communicate with the modular encoders only when the modular encoders are removably housed or otherwise incorporated in system 300.

In addition to input/output interface 315, display 316, and keypad 317, system 300 can also be provided with additional input/output devices (not shown), such as a biometric features reader, a pointing device, a printer, and the like. The various components of system 300 communicate through a system bus 312 or similar architecture. In addition, system 300 can include an operating system (OS) 320 that resides in memory 310 during operation. As to display 316 and keypad 317, these components can be implemented using components that are well known to those skilled in the art. One skilled in the art will also recognize that other components and peripherals may be included in system 300.

The foregoing description is illustrative, and variations in configuration and implementation may occur to persons skilled in the art. For instance, the various illustrative logics, logical blocks, modules, and circuits described in connection with the embodiments disclosed herein can be implemented or performed with a general purpose processor (e.g., processor 302), a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor can be a microprocessor, but, in the alternative, the processor can be any conventional processor, controller, microcontroller, or state machine. A processor can also be implemented as a combination of computing devices, e.g., a combination of a DSP and a microprocessor, a plurality of microprocessors, one or more microprocessors in conjunction with a DSP core, or any other such configuration.

In one or more exemplary embodiments, the functions described herein can be implemented in hardware, software, firmware, or any combination thereof. For a software implementation, the techniques described herein can be implemented with modules (e.g., procedures, functions, subprograms, programs, routines, subroutines, modules, software packages, classes, and so on) that perform the functions described herein. A module can be coupled to another module or a hardware circuit by passing and/or receiving information, data, arguments, parameters, or memory contents. Information, arguments, parameters, data, or the like can be passed, forwarded, or transmitted using any suitable means including memory sharing, message passing, token passing, network transmission, and the like. The software codes can be stored in memory units and executed by processors. The memory unit can be implemented within the processor or external to the processor, in which case it can be communicatively coupled to the processor via various means as is known in the art.

The scope of the present teachings is accordingly intended to be limited only by the following claims, and modifications and equivalents may be made to the features of the claims without departing from the scope of the present teachings.

What is claimed is:

1. An apparatus for performing physical access control, comprising:

a housing having a dock formed in the housing;

access control electronics contained in the housing; and a modular encoder unit removably incorporated in the dock, the modular encoder being communicatively linked to the access control electronics when removably incorporated in the housing, wherein the modular encoder unit receives identity data from the access control electronics and binds the identity data to a credential, the credential being separate from the modular encoder and removable from the modular encoder;

wherein the credential is selected from a group consisting of a magnetic stripe card, a proximity card, a contact smart card, a contactless smart card, and a radio frequency identification device.

2. The apparatus of claim 1, further comprising:

a communication interface that communicatively links the modular encoder unit to the access control electronics when the modular encoder unit is removably incorporated in the dock.

3. The apparatus of claim 1, further comprising:

a user interface on a surface of the housing, wherein the access control electronics receives authentication data via the user interface and binds the authentication data to the credential.

4. The apparatus of claim 3, wherein the authentication data includes at least one of a personal identification number, a password, or a biometric feature.

5. The apparatus of claim 3, wherein the access control electronics retrieves authentication data associated with the credential and presents the authentication data via the user interface.

6. The apparatus of claim 5, wherein the authentication data includes at least one of a personal identification number, a password, or a biometric feature.

7. The apparatus of claim 1, further comprising:

a securing mechanism attached to the housing for securing the modular encoder unit to the housing when the modular encoder unit is in a registered position within the dock.

8. An apparatus for performing physical access control, comprising:

a housing having a dock formed in the housing;

access control electronics contained in the housing; and a modular encoder unit removably incorporated in the dock, the modular encoder being communicatively linked to the access control electronics when removably incorporated in the housing, wherein the modular encoder unit retrieves identity data from a credential and provides the identity data to the access control electronics, the credential being separate from the modular encoder and removable from the modular encoder;

wherein the credential is selected from a group consisting of a magnetic stripe card, a proximity card, a contact smart card, a contactless smart card, and a radio frequency identification device.

* * * * *